US008373603B2

(12) United States Patent
Montgomery et al.

(10) Patent No.: US 8,373,603 B2
(45) Date of Patent: Feb. 12, 2013

(54) DUAL FEED ANTENNA

(75) Inventors: Mark T. Montgomery, Melbourne Beach, FL (US); Paul A. Tornatta, Melbourne, FL (US)

(73) Assignee: SkyCross, Inc., Viera, FL (US)

( * ) Notice: Subject to any disclaimer, the term of this patent is extended or adjusted under 35 U.S.C. 154(b) by 653 days.

(21) Appl. No.: 12/644,718

(22) Filed: Dec. 22, 2009

(65) Prior Publication Data

US 2010/0156726 A1 Jun. 24, 2010

Related U.S. Application Data

(60) Provisional application No. 61/140,370, filed on Dec. 23, 2008.

(51) Int. Cl.
*H01Q 1/24* (2006.01)

(52) U.S. Cl. ..... 343/702; 343/700 MS

(58) Field of Classification Search ..... 343/700 MS, 343/702, 895

See application file for complete search history.

(56) References Cited

U.S. PATENT DOCUMENTS

| | | | | |
|---|---|---|---|---|
| 6,313,809 | B1 | 11/2001 | Gabriel et al. | |
| 6,888,510 | B2 | 5/2005 | Jo et al. | |
| 7,265,718 | B2 | 9/2007 | Tsai | |
| 2002/0183013 | A1* | 12/2002 | Auckland et al. | 455/73 |
| 2004/0140942 | A1 | 7/2004 | Gottl | |
| 2007/0164906 | A1 | 7/2007 | Tsai | |
| 2008/0024378 | A1 | 1/2008 | Kanno et al. | |
| 2008/0143613 | A1 | 6/2008 | Iwai et al. | |
| 2008/0174508 | A1 | 7/2008 | Iwai et al. | |
| 2009/0156118 | A1* | 6/2009 | Schadler | 455/25 |
| 2010/0007572 | A1 | 1/2010 | Jones et al. | |

FOREIGN PATENT DOCUMENTS

| | | |
|---|---|---|
| KR | 10-2006-0099601 | 9/2006 |
| WO | WO-2004-100315 A1 | 11/2004 |
| WO | WO-2008-131157 A1 | 10/2008 |

OTHER PUBLICATIONS

Famdie et al., "Numerical Analysis Of Characteristic Modes On The Chassis Of Mobile Phones" Antennas and Propagation, 2006, EuCAP 2006.

International Search Report and Written Opinion for PCT/US2009/069225 dated Jul. 1, 2010.

International Search Report and Written Opinion for PCT/US2009/069233 dated Jun. 30, 2010.

* cited by examiner

*Primary Examiner* — Tan Ho

(74) *Attorney, Agent, or Firm* — Rajesh Vallabh; Foley Hoag LLP

(57) ABSTRACT

A multi-port antenna structure for a wireless-enabled communications device includes a coupler-antenna having a first antenna port for transmitting electromagnetic signals and a second antenna port for receiving electromagnetic signals. The coupler-antenna is positioned on a chassis of the wireless enabled communications device to transmit energy between the chassis and the first and second antenna ports. Resonant modes of the chassis for one antenna port are orthogonal to resonant modes of the chassis for the other antenna port, such that the first and second antenna ports are isolated from each other.

20 Claims, 10 Drawing Sheets

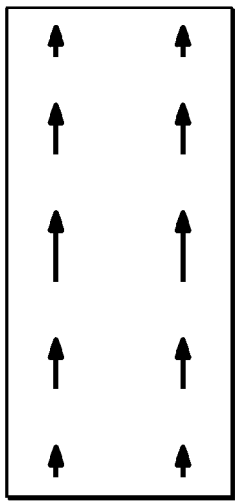
FIG. 2A
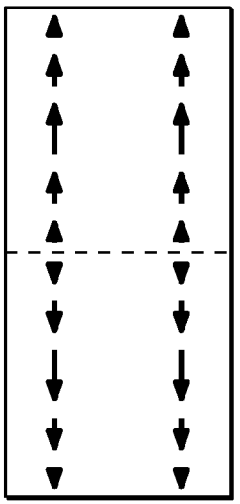
FIG. 2B
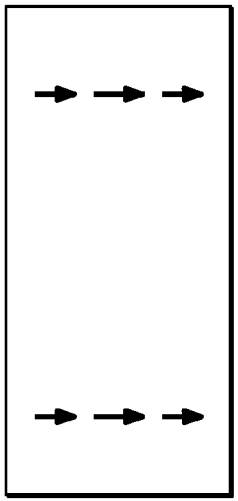
FIG. 2C
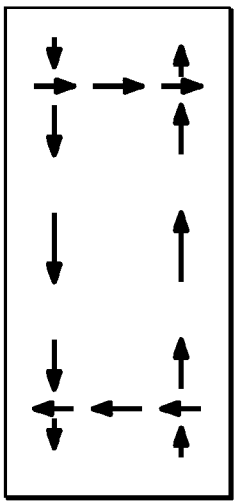
FIG. 2D
FIG. 3A
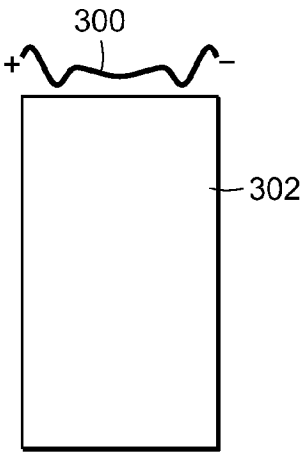
FIG. 3B
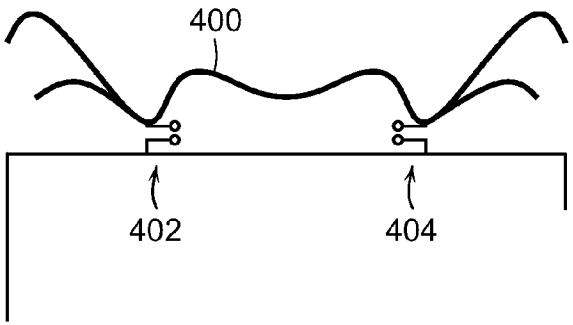
FIG. 4

| Protocol | | Frequency | | |
|---|---|---|---|---|
| GSM900 | TX | 880-915 MHz | 10 MHz | GSM Europe |
| | RX | 925-960 MHz | | |
| GSM1800 | TX | 1710-1785 MHz | 20 MHz | |
| | RX | 1805-1880 MHz | | |
| GSM850 | TX | 824-849 MHz | 20 MHz | GSM North America |
| | RX | 869-894 MHz | | |
| GSM1900 | TX | 1850-1910 MHz | 20 MHz | |
| | RX | 1930-1990 MHz | | |
| WCDMA | TX | 1920-1980 MHz | 130 MHz | WCDMA |
| | RX | 2110-2170 MHz | | |

DUAL FEED ANTENNA

CROSS REFERENCE TO RELATED APPLICATION

This application claims priority from U.S. Provisional Patent Application Ser. No. 61/140,370 filed on Dec. 23, 2008 and entitled Planar Three-Port Antenna and Dual Feed Antenna, which is hereby incorporated by reference.

BACKGROUND

The present invention relates generally to wireless communications devices and, more particularly, to antennas used in such devices.

Many communications devices require antennas that are packaged within a small device or product. Common examples of such communications devices include portable communications products such as cellular handsets, personal digital assistants (PDAs), and wireless networking devices or data cards for personal computers (PCs). These devices often use a single antenna for both transmission and reception of wireless signals.

A conventional approach is to use a single port antenna for both transmit and receive functions. Because the local transmit signal is at a much higher power than the receive signals, a substantial amount of isolation between transmit and receive paths is needed, particularly because transmit and receive paths are connected at a common point at the antenna port. For time division duplexed architectures, the isolation is typically provided by a transmit/receive (TX/RX) select switch so that the antenna is only connected to the transmit circuitry during the transmit period, and only to the receive circuitry during the receive period. In the case of full duplex architectures, the isolation is obtained through use of a duplexer. In either case, because the transmit and receive frequency bands are slightly offset from each other, additional isolation is obtained by use of narrow band pass filters in particular in the receive circuitry.

An alternate approach is to use two separate antennas, one for transmit and one for receive, thereby relieving the isolation requirement of either the switch or duplexer because the transmit and receive paths are no longer connected at a common point. However, in general this is of limited utility for a handset or other portable wireless communication devices because the addition of a second antenna to the handset generally results in a two-antenna system where one antenna port is poorly isolated from the other due to electromagnetic coupling between the antennas and by coupling through a common ground structure. This coupling is problematic in handheld wireless devices for several reasons. First, at the desired frequencies of operation such as the cellular band (approximately 900 MHz), the size of a handset does not allow for antennas to be placed more than a fraction of a wavelength apart. Second, because consumer acceptance requires antennas to be embedded (or very low profile) such that the major portion of the antenna is provided by the phone chassis itself while the "antenna" may be better described as an exciter or a coupler-antenna, which transmits energy between the chassis and the antenna ports. Therefore, a two antenna approach may still in large part provide a common connection to a single antenna, i.e., the chassis. Furthermore, the operable bands of the antennas tend to overlap such that isolating the antennas by filtering (i.e., diplexing) is problematic. The bandwidth of a single antenna resonance is described by the antenna Q, and the number of poles characteristic of the resonators comprising the antenna system. In typical handsets, this is a two or 4-pole system, and does not have sufficient selectivity to isolate the receive and transmit band structure.

In applications where it is desirable to relax the isolation requirement of the switch, it is generally necessary to provide greater decoupling of the receive and transmit antennas. In accordance with one or more embodiments, a technique is provided utilizing a unique two-port antenna that may be embedded in a handset to achieve substantial isolation between ports thereby providing a means to realize the advantage of separate TX and RX ports. This method has the advantage that the requirement for a TX/RX switch or duplexer may be eliminated altogether or the performance requirements for these components may be relieved allowing for simpler or more cost-effective alternatives.

BRIEF SUMMARY OF EMBODIMENTS OF THE INVENTION

A multi-port antenna structure for a wireless-enabled communications device in accordance with one or more embodiments of the invention includes a coupler-antenna having a first antenna port for transmitting electromagnetic signals and a second antenna port for receiving electromagnetic signals. The coupler-antenna is positioned on a chassis of the wireless enabled communications device to transmit energy between the chassis and the first and second antenna ports. Resonant modes of the chassis for one antenna port are orthogonal to resonant modes of the chassis for the other antenna port, such that the first and second antenna ports are isolated from each other.

Various embodiments of the invention are provided in the following detailed description. As will be realized, the invention is capable of other and different embodiments, and its several details may be capable of modifications in various respects, all without departing from the invention. Accordingly, the drawings and description are to be regarded as illustrative in nature and not in a restrictive or limiting sense, with the scope of the application being indicated in the claims.

BRIEF DESCRIPTION OF THE DRAWINGS

FIGS. 2A-2D illustrate four characteristic modes for a rectangular sheet conductor representative of the size of a PCB assembly that may be found in a handset device.

FIGS. 3A and 3B illustrate an exemplary antenna in accordance with one or more embodiments of the invention.

FIG. 4 illustrates an exemplary antenna in accordance with one or more embodiments of the invention.

DETAILED DESCRIPTION

Many wireless communications protocols require use of multiple wireless channels in the same frequency band either to increase the information throughput or to increase the range or reliability of the wireless link. This requires use of multiple independent antennas. It is generally desirable to place the antennas as close together as possible to reduce the size of the antenna system. However placing antennas in close proximity can lead to undesirable effects of direct coupling between antenna ports and diminished independence, or increased correlation, between the radiation patterns of the antennas.

Figure 1:
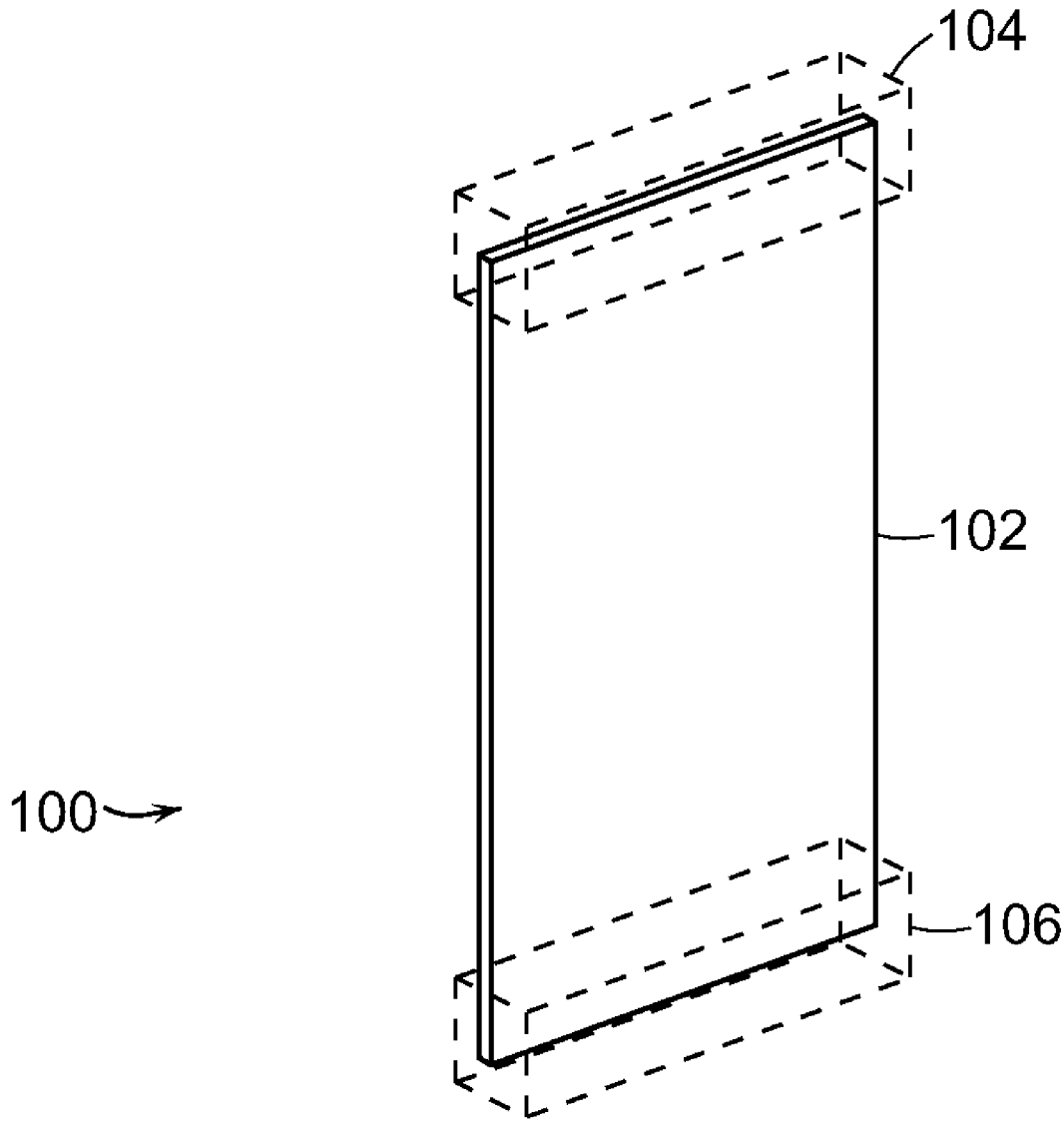
FIG. 1 schematically illustrates a handset device.

FIG. 1 is a schematic illustration of a handset device 100. A handset typically includes a number of electronic components such as a display, keyboard, and battery (not shown in FIG. 1). The handset device 100 also includes a printed circuit board (PCB) assembly 102, which provides an electrically conductive core. The antenna is attached to circuitry on the PCB 102, which typically has a continuity of RF ground running most of the area of the PCB 102 and of the phone itself. Embedded antennas are typically located at either the top 104 or bottom 106 of the handset electronics assembly as identified on the FIG. 1, but inside the outermost enclosure.

A basic understanding of antenna operation can be obtained by representation of the PCB and electronics as a rectangular conductor. The long dimension, referred to here as height, is typically around 10 cm and the short dimension, or width, is typically about half the height. This means that at cellular band frequencies near 900 MHz, the height is close to one-third the free-space wavelength (33 cm). An antenna may be fed from the end of the PCB such that the PCB ground plane acts as a counterpoise to the antenna. However the antenna may be allowed to extend no more than one or two centimeters from the counterpoise to meet the goals for overall size and appearance of the handset. Thus, the length of the antenna in terms of the distance it extends from the counterpoise is a very small fraction of a wavelength such that, taken by itself, the performance of the antenna would be severely limited by the small size. This is in fact not a limitation because the antenna can couple to the counterpoise such that the two together function as a larger antenna. The antenna can accordingly be described as an exciter or coupler-antenna, which transmits energy between the counterpoise and the antenna ports.

If a second antenna is added to operate at the same frequency (or nearly the same frequency as in the case of TX/RX sub-bands), the antenna ports may not be isolated from each other because both antennas are coupled to the common counterpoise and thereby coupled together. This is true because without careful design to avoid it, both antennas will excite the dominant resonant mode of the counterpoise at the frequency of operation. In the case of the cellular frequencies, this is expected to be the half-wave resonance of the long dimension of the counterpoise as this is the lowest frequency radiation mode.

Famdie et al. (Famdie, Celestin Tamgue; Schroeder, Werner L.; Solbach, Klaus, "Numerical Analysis Of Characteristic Modes On The Chassis Of Mobile Phones," Antennas And Propagation, 2006. EuCAP 2006. First European Conference, vol., no., pp. 1-6, 6-10 Nov. 2006) have identified the first four characteristic modes for a rectangular sheet conductor of dimensions 100 mm length by 40 mm width as depicted in FIGS. 2A-2D. This sheet is representative of the general size of PCB assembly that may be found in a handset device. Arrows depict the flow of electrical current on the conductor with the length of the arrows representing the relative magnitude. For example, for the first mode (FIG. 2A), the current is at a maximum at the middle of the sheet and diminishes in sinusoidal fashion to zero flow at the ends. This is the half-wave resonance along the long dimension, which for this particular geometry occurs at approximately 1300 MHz. The next resonant mode is the full-wave resonance along the long dimension as depicted on FIG. 2B and occurs at approximately twice the frequency of the first mode. The next mode (FIG. 2C) is the half-wave resonance along the short dimension, which is more than twice the first resonant frequency in this case as the short dimension is less than half the long dimension. A fourth mode (FIG. 2D) has currents on both axes, but with opposite phase from left to right or top to bottom. Further modes can be identified at higher frequencies, but the effectiveness as an antenna mode diminishes as the resonance frequencies are increasingly further from the desired operating frequency.

Given that the next higher modes are approximately twice the frequency of the first characteristic mode, the first mode is by far the most effective antenna mode and the easiest to excite. This mode is effectively excited by an antenna positioned at the end of the counterpoise. If two antennas are positioned at the end of the counterpoise, then both tend to couple to the same fundamental characteristic mode and consequently a signal applied at one antenna port will tend to be coupled to the second antenna port. What is needed to avoid the port to port coupling therefore is an antenna system that will excite different resonant modes of the counterpoise depending on which port is used.

One example of such an antenna is shown diagrammatically in FIGS. 3A and 3B. The antenna 300 In accordance with one or more embodiments is positioned at one end of the counterpoise 302 and spans the width of the counterpoise. The antenna 300 has sufficient electrical length to support two resonant modes: the common mode and differential mode as depicted in FIGS. 3A and 3B, respectively. The plus and minus symbols represent the relative phase of the electric potential at the ends of the antenna associated with the modes. Thus, for the common mode, the potentials are in-phase, while for the differential mode, the potentials at either end are opposite-phase.

The common mode is effective for driving only counterpoise modes 1 or 2 (shown in FIGS. 2A and 2B, respectively), but mode 1 will dominate for low frequencies (i.e., frequencies near to or below the resonant frequency of the first mode). The differential mode is effective only for driving counterpoise modes 3 or 4 (shown in FIGS. 2C and 2D, respectively). Neither mode 3 or 4 is as effective a radiation mode as mode 1 at low frequencies, because the radiation effectiveness diminishes for frequencies below the resonant frequency. The consequence of this is that these modes must be driven much harder to produce radiation than is required for mode 1. Nonetheless, at least one of these additional modes is used to obtain the isolation between antenna ports.

FIG. 4 illustrates an antenna 400 with two ports 402, 404, with each port located between the end of the antenna and its midpoint. Application of a signal to port 1 (402) or port 2 (404) will excite all four counterpoise modes. However, the relative phase between the counterpoise modes will be different depending on which port is used. In particular, the phase of modes 3 and 4 excited by port 1 will be opposite those that would be excited by port 2, while the phases of modes 1 and 2 would be the same. This allows for port 1 to excite a resonant mode that is orthogonal from that excited by port 2. For example, port 1 may excite mode 1 plus mode 4, while port 2 may excite mode 1 minus mode 4. In this case, port 1 will be isolated from port 2.

The resonant frequencies of the antenna may be manipulated by adjusting the electrical length from the antenna ports to the ends of the antenna, with a longer electrical length corresponding to a lower resonant frequency. The amount of isolation between ports may be manipulated by adjusting the electrical length of the section between the two ports. In this way isolation between ports may be obtained at a particular desired frequency. Multiple resonant frequencies may be obtained by using multiple branches (having multiple electrical lengths) for the sections of antenna beyond the ports.

Figure 5A:
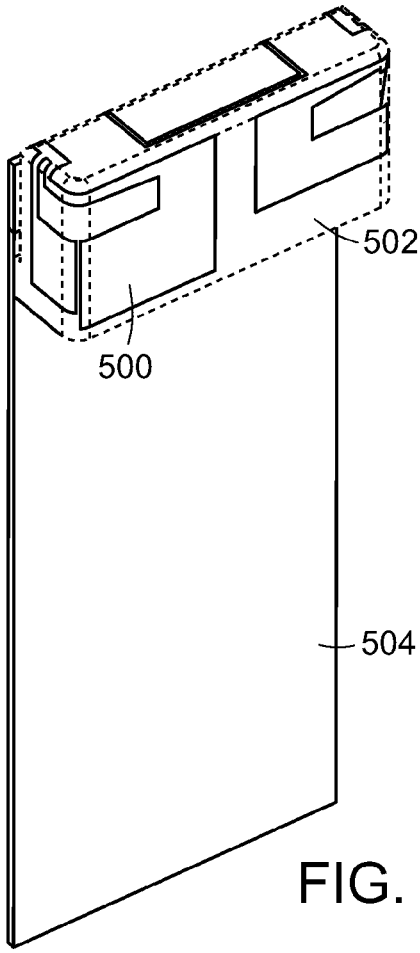
FIGS. 5A and 5B illustrate an exemplary antenna in accordance with one or more embodiments of the invention.

FIG. 5A illustrates an antenna 500 In accordance with one or more embodiments. In this example, the antenna 500 is designed to provide separate transmit and receive ports for a dual-band GSM handset. The antenna 500 is formed from a copper pattern on a flexible printed circuit (FPC) that is wrapped onto a plastic carrier 502. The antenna 500 is designed to be mounted at the end of a PCB 504 found in a cellular handset. The antenna FPC has two exposed contact pads 506, 508 that are the points of contact between the transmit and receive electrical circuitry on the PCB and the ports of the antenna.

Figure 5B:
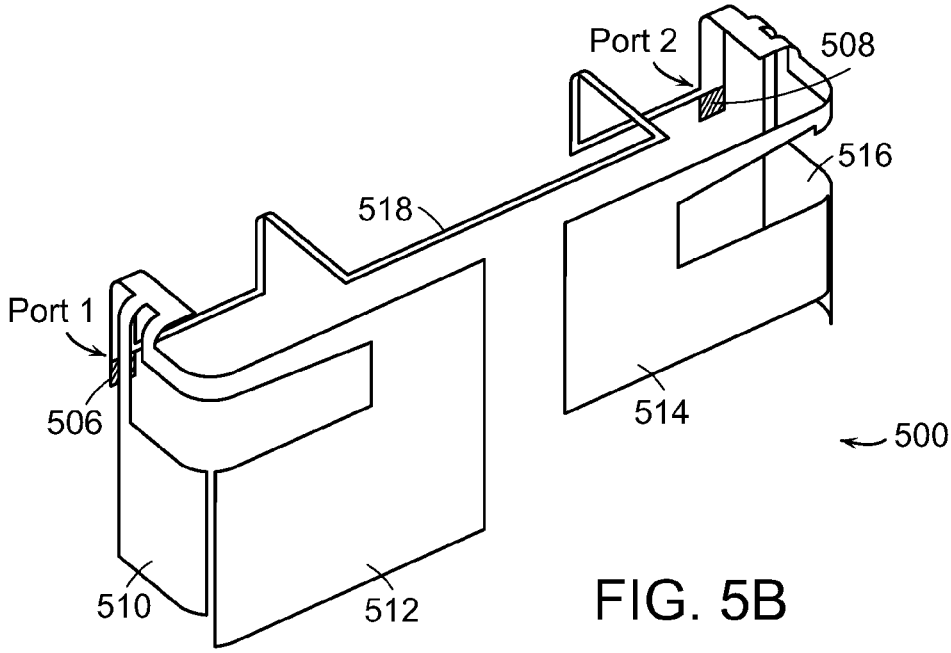

Details of the shape of the antenna copper pattern are shown in FIG. 5B. The antenna includes four branches 510, 512, 514, 516 (two at each end), two feed pads 506, 508 where the antenna ports are located, and a segment 518 between the two sets of branches. Thus, this antenna is a particular three-dimensional embodiment of the form of antenna shown on FIG. 4. The larger of the branches 510, 512 are sized for antenna operation at the GSM frequency band from 880 to 960 MHz. The shorter branches 514, 516 are sized for antenna operation at the GSM frequency band of 1710 to 1880 MHz.

To reduce the physical size of the antenna, the shapes are provided with narrow widths and meandering paths nearer to the feed ports for inductive loading and broader widths at the ends for capacitive top loading, both with the purpose of making the antenna electrically longer. The branches on opposite sides of the antenna are of similar geometry, but unequal lengths. The difference in length is to generally optimize the impedance matching for the respective ports, which have different frequency requirements. Port 1 is the point of connection for the transmit circuitry, which uses the lower portions of the GSM bands, 880 to 915 MHz and 1710 to 1785 MHz. Port 2 is the point of connection for the receive circuitry, which uses the upper portions of the GSM bands, 925 to 960 MHz and 1805 to 1880 MHz.

The portion between the antenna branches is meandered to increase electrical length. The electrical length and inductance of this section has a large effect on the amount of isolation obtained between ports and a lesser effect on shifting the frequency response of the antenna or tuning. In contrast, the lengths of the antenna branches strongly affect tuning, but have only a weak affect on the isolation between ports. Thus, between these two adjustments, the amount of isolation and the frequency at which it occurs can be manipulated for particular design requirements.

Similarly, in terms of modal behavior, the lengths of the antenna branches primarily affect the frequency at which the antenna couples to the resonant modes of the counterpoise, and so affects tuning. The characteristic of the antenna section between the branches has a strong affect on the modal content of the antenna and therefore the modal excitation of the counterpoise. When the length and shape of this section are changed, it affects the proportion of the common mode relative to the differential mode on the antenna. When the appropriate amount of differential excitation is achieved, the modal excitation of the counterpoise from one port is orthogonal to that produced by the other port, and port to port isolation is obtained.

Figure 6A:
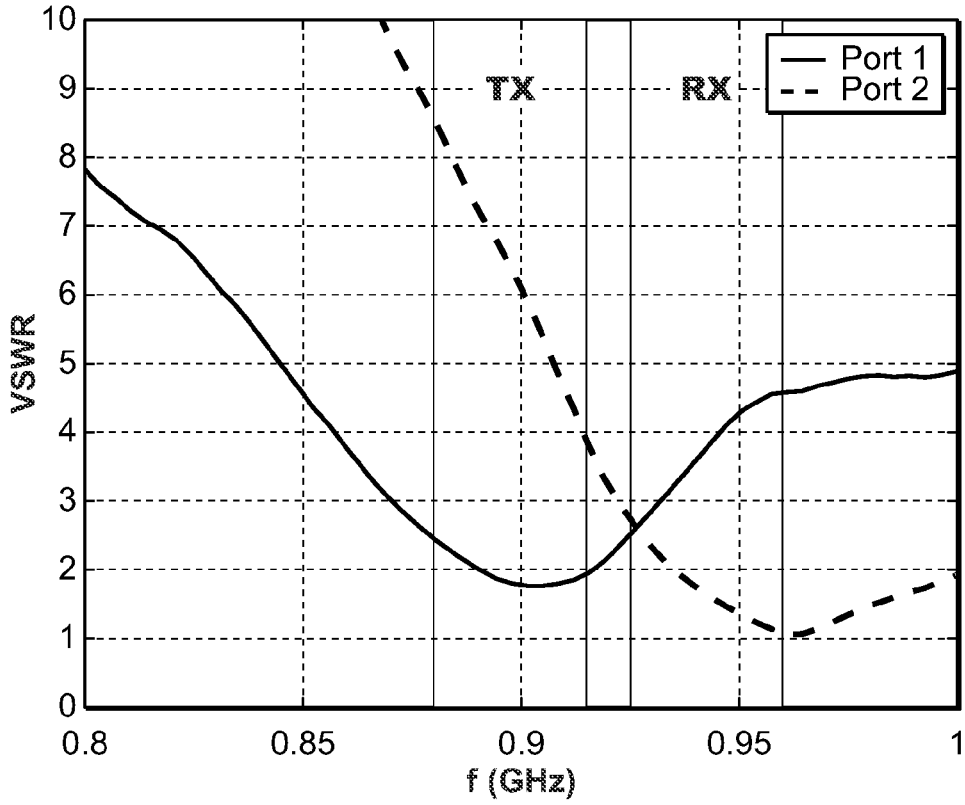
FIGS. 6A-6F illustrate characteristics of the FIG. 5 antenna.
Figure 6B:
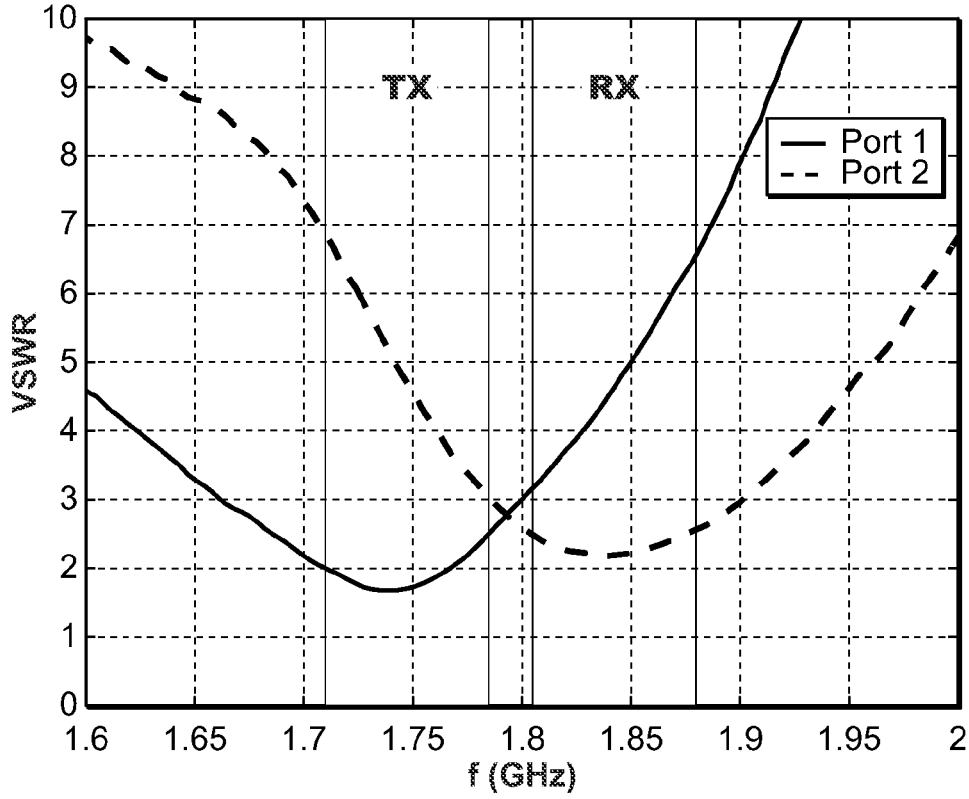
Figure 6C:
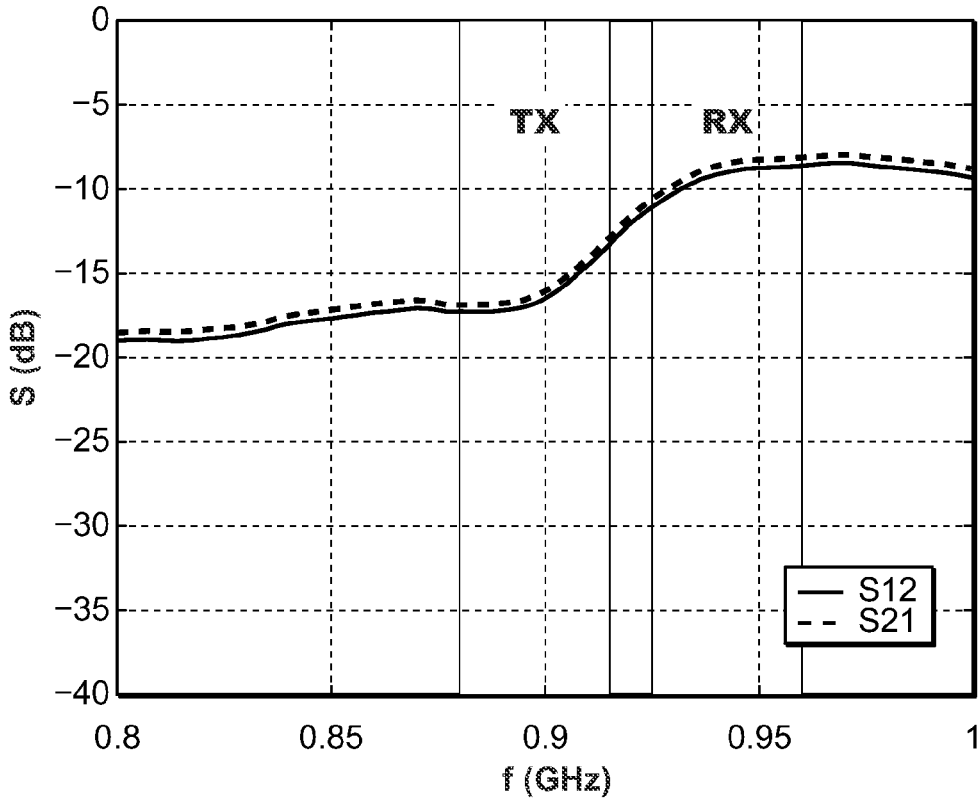
Figure 6D:
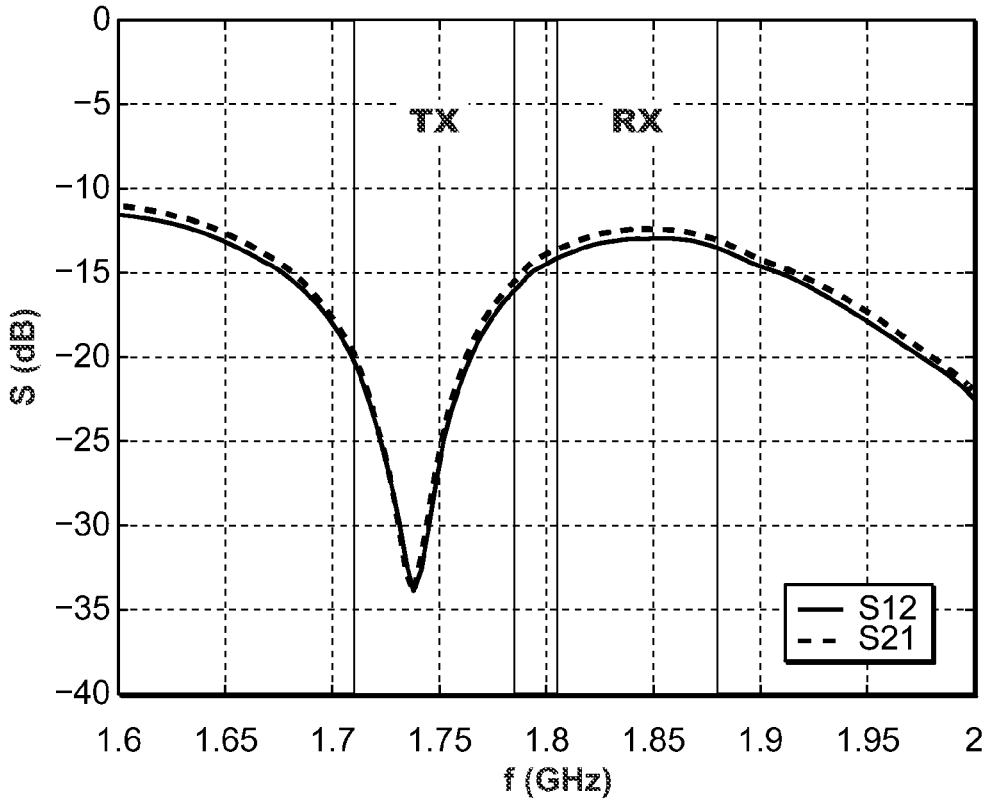
Figure 6E:
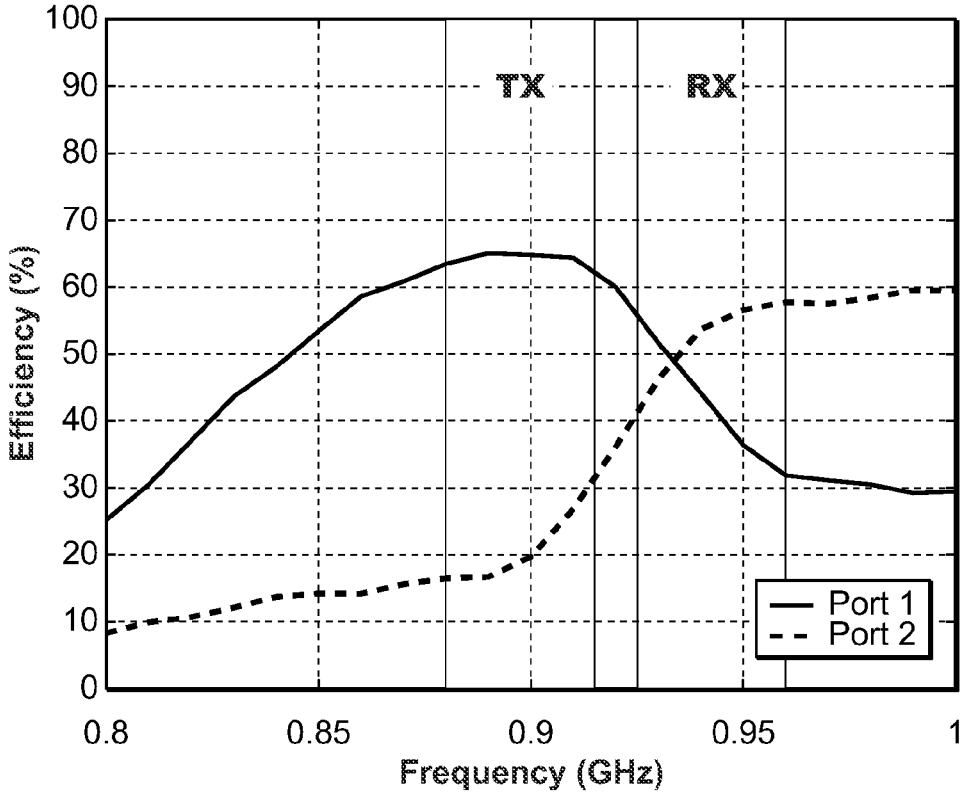
Figure 6F:
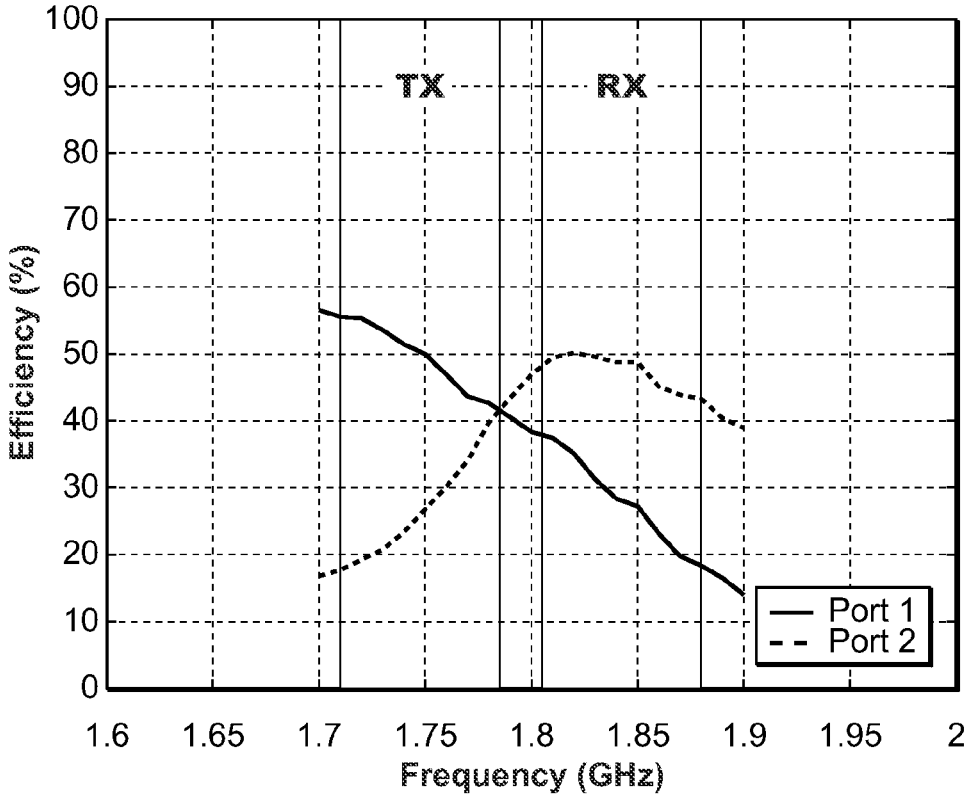

The antenna can be used with a matching network to generally optimize the antenna input impedance match to transmit and receive circuitry. For this antenna, a three component lumped element matching network is used for both receive and transmit. Graphs of the VSWR measurements for the antenna plus matching networks are provided as FIGS. 6A and 6B, for the 900 MHz and 1800 MHz bands, respectively. Graphs of the port coupling parameters S12 and S21 are provided as FIGS. 6C and 6D. In this case, the tuning is arranged such that the greatest isolation occurs over the transmit portions of the band. This arrangement is optimized for isolating the receiver circuitry from the high power transmitted within the transmit band. Graphs of efficiency, provided as FIGS. 6E and 6F show that the realized efficiency including the matching network is approximately 50 percent.

While multiple frequency operation may be obtained by the use of multiple antenna branches, the complexity of the antenna is increased with the number of frequency bands and the required antenna size may need to increase. Alternately, the electrical lengths of one or more branches may be made adjustable so that antenna may be dynamically tuned to operate in a selected frequency band. This is particularly useful for devices that may operate in different frequency bands at different periods of time, but do not simultaneously operate at more than one frequency band at any one time.

Figures 7, 8:
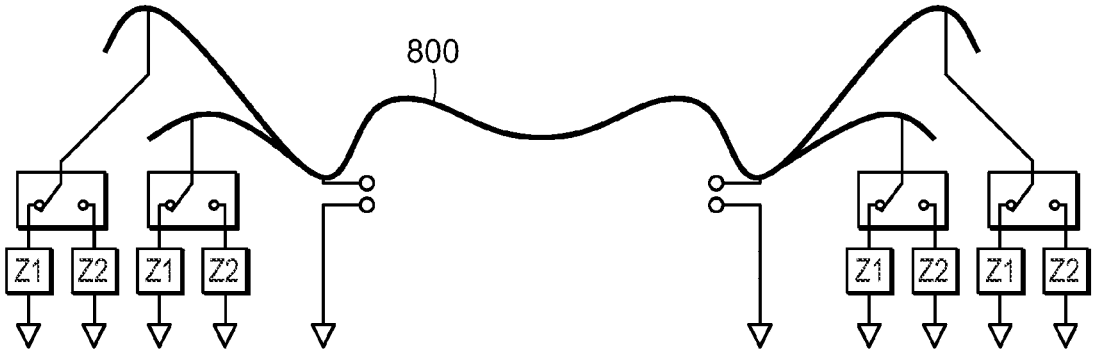
FIG. 7 is a table of selected GSM frequency bands for which a single handset may be required to operate.
FIG. 8 illustrates an exemplary antenna in accordance with one or more embodiments of the invention.

Cellular handsets are an example of devices that generally require multiband functionality, but operate only within a single frequency band at any given time. FIG. 7 provides a table of selected GSM frequency bands for which single handset may be required to operate.

FIG. 8 is a diagram of an exemplary antenna 800 in accordance with one or more embodiments that uses a combination of switched loading and multiple antenna branches to obtain a quadband operation, e.g., GSM 850, GSM900, GSM1800, and GSM1900 bands. The use of two branches on either end of the antenna 800 provides for two band operation as per the example of FIG. 4. Each branch is made to have two selectable electrical lengths by means of connecting the antenna branch to ground through an impedance of Z1 or impedance Z2. For example, Z1 may be one value of capacitance, and Z2 may be a second larger value of capacitance, such that switching to load Z1 aligns the antenna response to one frequency band of operation, while switching to load Z2 aligns the antenna to a second lower frequency of operation. Note that Z1 and Z2 represent two different load impedances for a particular branch but the same values of Z1 and Z2 are not necessarily applied to each branch.

Figure 9:
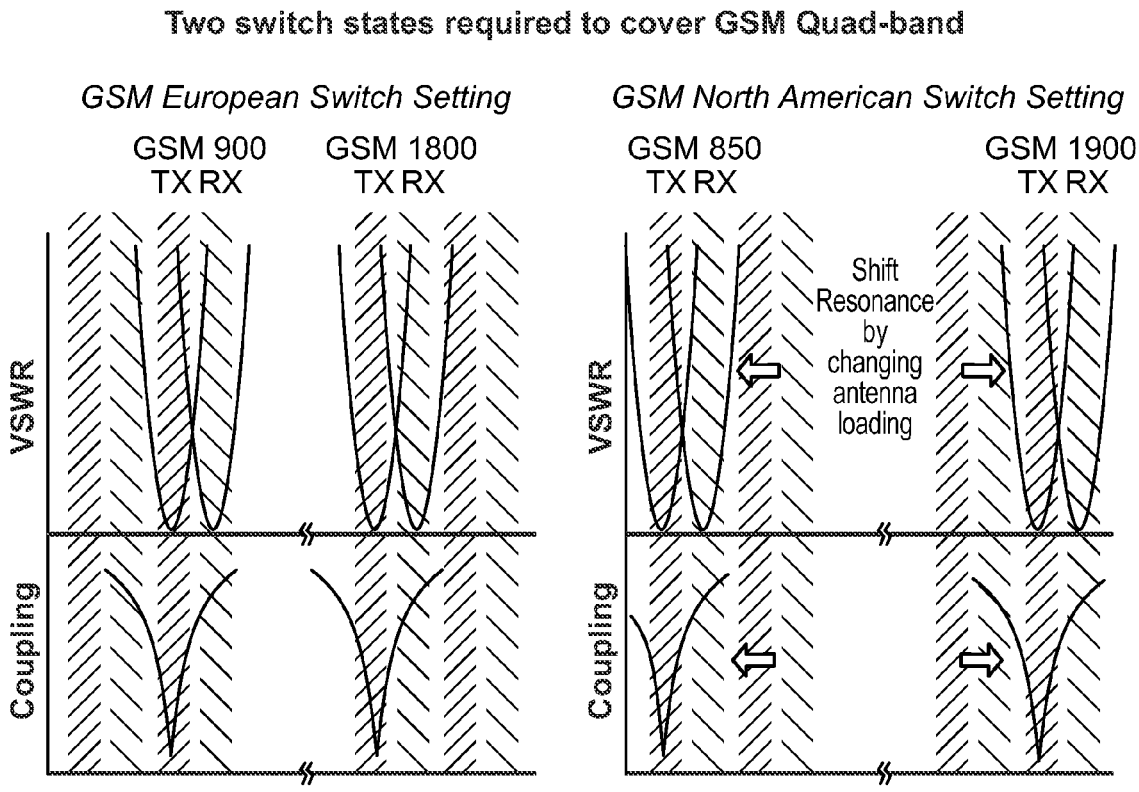
FIG. 9 illustrates characteristics of the FIG. 8 antenna.

The configuration of FIG. 8 may be used to produce a two-state switchable antenna with the VSWR and isolation characteristics shown on FIG. 9. In the first state, the antenna is tuned to dual-band GSM850/1900 operation as may be suitable for European cellar services. In the second state, the antenna is tuned to dual-band GSM900/1800 operation as may be suitable for cellar services in the United States.

Figure 10:
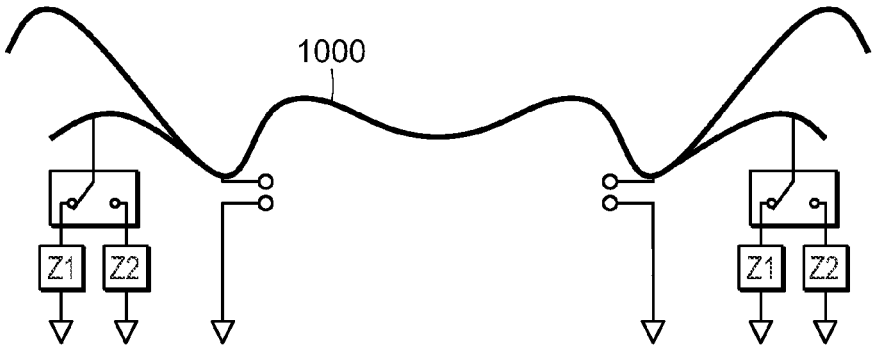
FIG. 10 illustrates an exemplary antenna in accordance with one or more embodiments of the invention.
Figure 11:
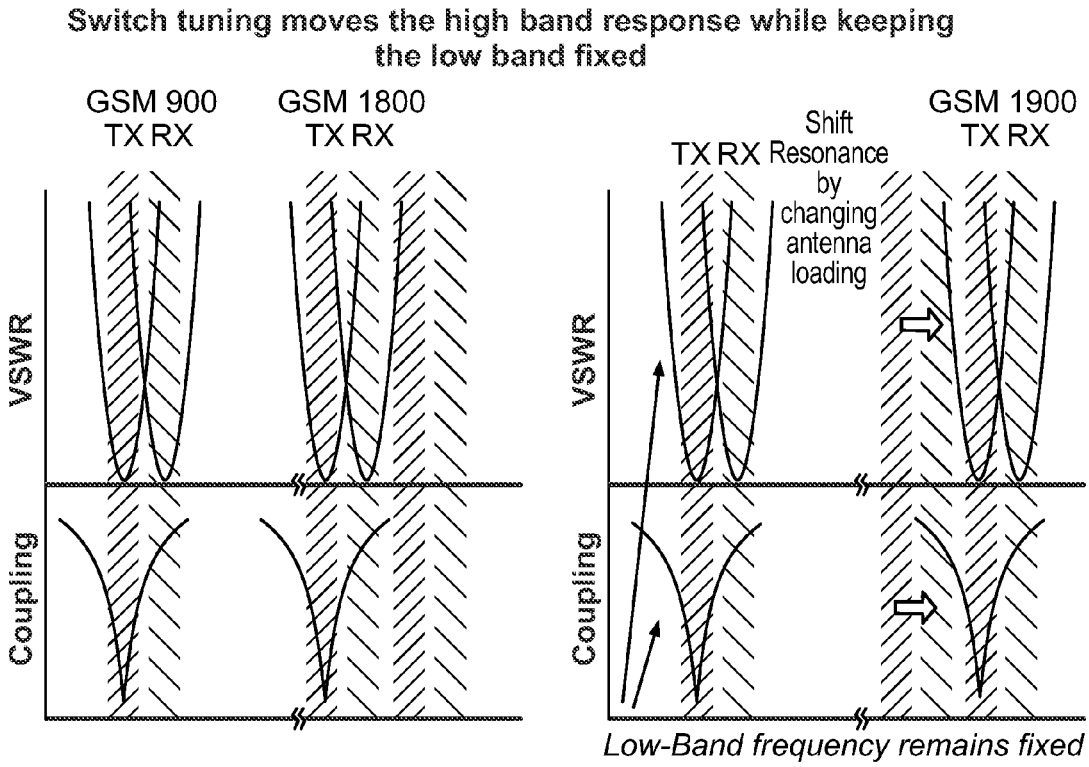
FIG. 11 illustrates characteristics of the FIG. 10 antenna.

FIG. 10 is a diagram of an exemplary antenna 1000 in accordance with one or more embodiments that uses a combination of switched loading and multiple antenna branches to obtain a triband operation, e.g., GSM900, GSM1800, and GSM1900 bands. The use of two branches on either end of the antenna provides for two band operation as per the example of FIG. 4. Unlike the quadband application of FIG. 8, only the shorter branches are made to have two selectable electrical lengths. This allows for the higher frequency band to be tuned between two states. The configuration of FIG. 10 may be used to produce a two-state switchable antenna with the VSWR and isolation characteristics shown on FIG. 11. In the first state, the antenna is tuned to dual-band GSM900/1800 dual-band GSM900/1900 operation.

Figure 12:
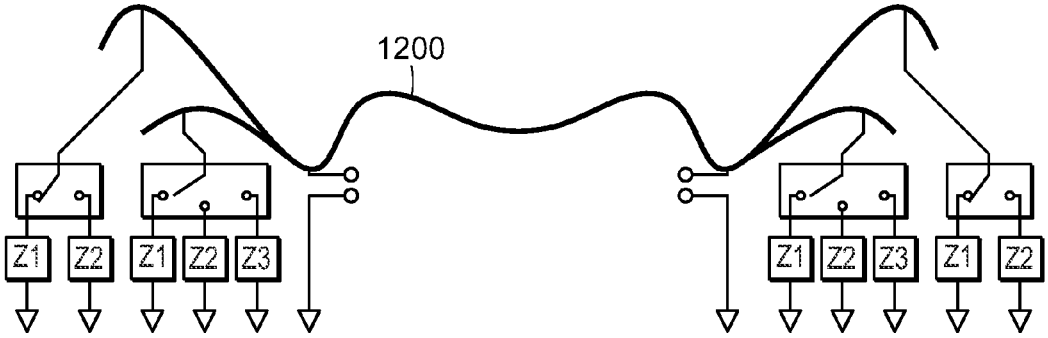
FIG. 12 illustrates an exemplary antenna in accordance with one or more embodiments of the invention.
Figure 13:
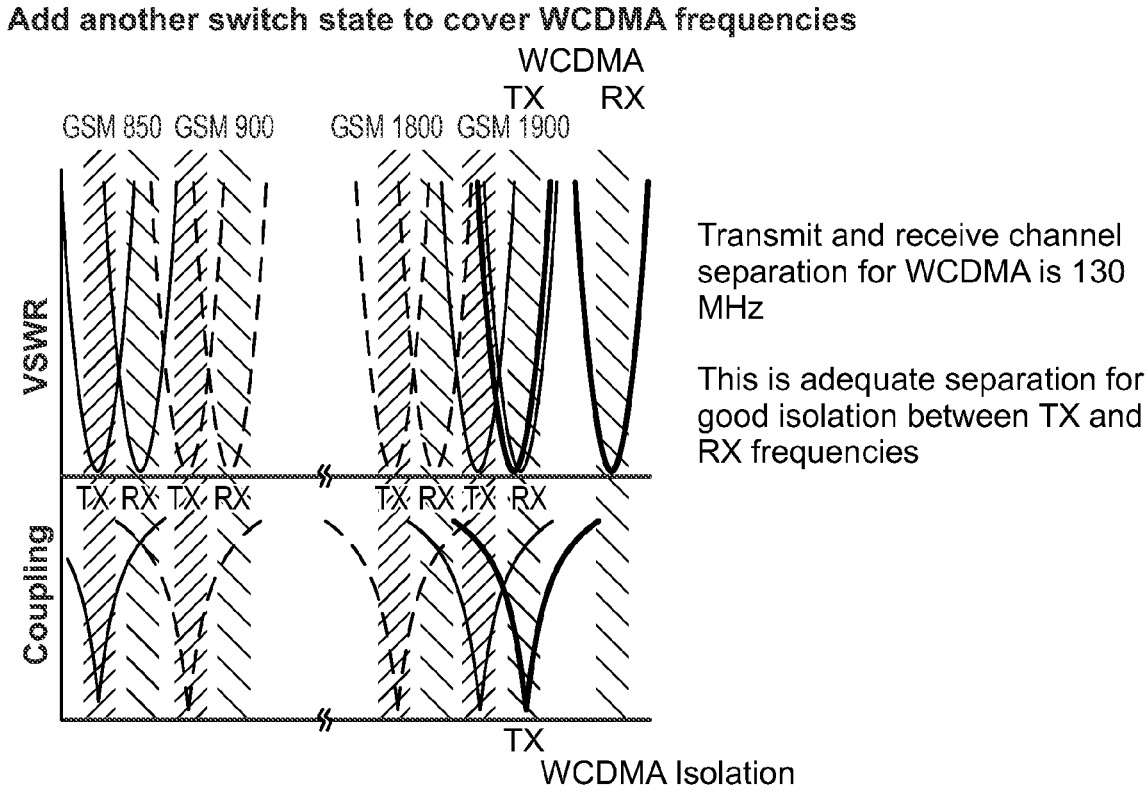
FIG. 13 illustrates characteristics of the FIG. 12 antenna.

FIG. 12 is a diagram of an exemplary antenna 1200 in accordance with one or more embodiments that uses a combination of switched loading and multiple antenna branches to obtain pentaband operation, for example GSM850, GSM900, GSM1800, and GSM1900 and WCDMA bands. The use of two branches on either end of the antenna provides for two band operation as per the example of FIG. 4. The shorter branches are made to have three selectable electrical lengths while the longer branches are made to have two selectable electrical lengths. This allows for the higher frequency band to be tuned between three states and the lower frequency band to be switched between two states. The configuration of FIG. 12 may be used to produce a multi-state switchable antenna with the VSWR and isolation characteristics shown on FIG. 13. The antenna can simultaneously support one of the low frequency bands (GSM850 or GSM900) or one of the higher frequency bands (GSM1800, GSM1900 or WCDMA bands).

It is to be understood that although the invention has been described above in terms of particular embodiments, the foregoing embodiments are provided as illustrative only, and do not limit or define the scope of the invention.

Various other embodiments, including but not limited to the following, are also within the scope of the claims. For example, the elements or components of the various antenna structures described herein may be further divided into additional components or joined together to form fewer components for performing the same functions.

Having described preferred embodiments of the present invention, it should be apparent that modifications can be made without departing from the spirit and scope of the invention.

What is claimed is:

1. A multi-port antenna structure for a wireless-enabled communications device, comprising:

a coupler-antenna having a first antenna port for transmitting electromagnetic signals and a second antenna port for receiving electromagnetic signals;

the coupler-antenna being positioned on a chassis of the wireless enabled communications device to transmit energy between the chassis and the first and second antenna ports, wherein resonant modes of the chassis for one antenna port are orthogonal to resonant modes of the chassis for the other antenna port, such that the first and second antenna ports are isolated from each other.

2. The multi-port antenna structure of claim 1, wherein the coupler-antenna is configured to support both common and differential resonant modes.

3. The multi-port antenna structure of claim 1, wherein the coupler-antenna has multiple resonant frequencies to provide multiple antenna functions in more than one frequency band.

4. The multi-port antenna structure of claim 1, wherein the coupler-antenna includes a plurality of branches, each having a given electrical length to provide multiple resonant frequencies.

5. The multi-port antenna structure of claim 4, wherein the electrical length of each branch can be changed to form a tunable antenna.

6. The multi-port antenna structure of claim 1, wherein the coupler-antenna has a meandering configuration to increase electrical length.

7. The multi-port antenna structure of claim 1, wherein the coupler-antenna is positioned at one end of the chassis.

8. The multi-port antenna structure of claim 1, wherein the coupler-antenna is formed from a conductive pattern on a substrate.

9. The multi-port antenna structure of claim 1, wherein the wireless enabled communications device comprises a cellular handset, a personal digital assistant, a wireless networking device, or a data card for a personal computer.

10. The multi-port antenna structure of claim 1, wherein the chassis comprises a printed circuit board.

11. A multi-port antenna structure for a wireless-enabled communications device, comprising:

a chassis of the wireless enabled communications device; and a coupler-antenna having a first antenna port for transmitting electromagnetic signals and a second antenna port for receiving electromagnetic signals, the coupler-antenna being positioned on the chassis to transmit energy between the chassis and the first and second antenna ports, wherein resonant modes of the chassis for one antenna port are orthogonal to resonant modes of the chassis for the other antenna port, such that the first and second antenna ports are isolated from each other.

12. The multi-port antenna structure of claim 11, wherein the coupler-antenna is configured to support both common and differential resonant modes.

13. The multi-port antenna structure of claim 11, wherein the coupler-antenna has multiple resonant frequencies to provide multiple antenna functions in more than one frequency band.

14. The multi-port antenna structure of claim 11, wherein the coupler-antenna includes a plurality of branches, each having a given electrical length to provide multiple resonant frequencies.

15. The multi-port antenna structure of claim 14, wherein the electrical length of each branch can be changed to form a tunable antenna.

16. The multi-port antenna structure of claim 11, wherein the coupler-antenna has a meandering configuration to increase electrical length.

17. The multi-port antenna structure of claim 11, wherein the coupler-antenna is positioned at one end of the chassis.

18. The multi-port antenna structure of claim 11, wherein the coupler-antenna is formed from a conductive pattern on a substrate.

19. The multi-port antenna structure of claim 11, wherein the wireless enabled communications device comprises a cellular handset, a personal digital assistant, a wireless networking device, or a data card for a personal computer.

20. The multi-port antenna structure of claim 11, wherein the chassis comprises a printed circuit board.

* * * * *